US008146187B2

(12) United States Patent
Lachenbruch et al.

(10) Patent No.: US 8,146,187 B2
(45) Date of Patent: Apr. 3, 2012

(54) MATTRESS AND MATTRESS REPLACEMENT SYSTEM WITH AND INTRINSIC CONTOUR FEATURE

(75) Inventors: Charles A. Lachenbruch, Lakeway, TX (US); Timothy Joseph Receveur, Guilford, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 72 days.

(21) Appl. No.: 12/787,591

(22) Filed: May 26, 2010

(65) Prior Publication Data

US 2011/0289690 A1 Dec. 1, 2011

(51) Int. Cl.

| | |
|---|---|
| ***A61G 7/015*** | (2006.01) |
| ***A47C 27/08*** | (2006.01) |
| ***A61G 7/057*** | (2006.01) |

(52) U.S. Cl. ..... 5/612; 5/615; 5/715; 5/713

(58) Field of Classification Search ..... 5/612, 615, 5/713, 715

See application file for complete search history.

(56) References Cited

U.S. PATENT DOCUMENTS

| | | | | |
|---|---|---|---|---|
| 4,017,118 | A | 4/1977 | Cawley | |
| 4,745,647 | A | 5/1988 | Goodwin | |
| 4,935,968 | A | 6/1990 | Hunt | |
| 5,051,673 | A * | 9/1991 | Goodwin | 318/481 |
| 5,611,096 | A * | 3/1997 | Bartlett et al. | 5/617 |
| 6,094,762 | A * | 8/2000 | Viard et al. | 5/713 |
| 6,115,860 | A * | 9/2000 | Vrzalik | 5/715 |
| 7,219,380 | B2 * | 5/2007 | Beck et al. | 5/713 |
| 7,487,562 | B2 * | 2/2009 | Frondorf et al. | 5/613 |
| 7,657,956 | B2 | 2/2010 | Stacy | |
| 7,685,658 | B2 * | 3/2010 | Lokhorst et al. | 5/424 |
| 7,690,060 | B2 | 4/2010 | Rodrigues Moreira | |
| 2005/0044631 | A1 | 3/2005 | Wang | |
| 2010/0064443 | A1 * | 3/2010 | Lee | 5/713 |

FOREIGN PATENT DOCUMENTS

| | | |
|---|---|---|
| DE | 3236632 A1 | 5/1984 |
| JP | 2007159981 | 6/2007 |
| WO | 97/05806 A1 | 2/1997 |

OTHER PUBLICATIONS

European Search Report accompanied by Examiner's Preliminary Opinion, "Application No. EP 11167705", (Sep. 2, 2011), The Hague, total number of pp. 5.

Response to European Search Report Opinion for EP Application 11167705.0 "Mattress with an Intrinsic Contour Feature" from Hill-Rom Services Inc. foreign counsel Reddie & Grose 16 Theobalds Road London WC1X 8PL to European Patent Office P B 5818 Patentlaan 2 NL-2280 HV Rijswijk ZH The Hague The Netherlands.

* cited by examiner

*Primary Examiner* — Michael Trettel
(74) *Attorney, Agent, or Firm* — Kenneth C. Baran

(57) ABSTRACT

A mattress for use on a bed frame has a lower body section 42 and a upper body section 40. The mattress upper body section is orientation adjustable in as a function of the orientation of the upper body section of the frame upon which the mattress rests. At least part 60 of the mattress lower body section is profile adjustable as a function of the orientation of the mattress upper body section without being dependent on profile adjustment of the lower body section of the frame. A mattress replacement system includes a mattress having an orientation adjustable upper body section and a lower body section. The mattress replacement system also includes an angular orientation sensor 58 for determining the orientation of the upper body section. At least part 60 of the mattress lower body section is profile adjustable in response to the determined orientation of the mattress upper body section.

26 Claims, 13 Drawing Sheets

MATTRESS AND MATTRESS REPLACEMENT SYSTEM WITH AND INTRINSIC CONTOUR FEATURE

TECHNICAL FIELD

The subject matter described herein relates to mattresses having a portion whose profile is adjustable in response to the orientation of the upper body section of the mattress, but independently of any adjustability of the part of the bed frame on which the profile adjustable portion of the mattress rests. One example application for the mattress and an associated mattress replacement system is as a component of a bed of the type used in hospitals and other health care facilities.

BACKGROUND

Beds of the type used in health care facilities and sometimes in home care settings include a longitudinally segmented or sectioned bed frame and a mattress supported on the frame. Typical bed frame sections include an upper body or torso section corresponding approximately to an occupant's torso, a seat section corresponding approximately to the occupant's buttocks, a thigh section corresponding approximately to the occupant's thighs, and a calf section corresponding approximately to the occupant's calves and feet. The seat, thigh and calf sections may be referred to collectively as a lower body section; the thigh and calf sections may be referred to collectively as a leg section. The upper body section is orientation adjustable from a substantially horizontal orientation to a more vertical orientation, typically about 65° or 70° relative to horizontal. The thigh and foot sections are also orientation adjustable in opposite rotational senses so that the mutually proximate ends of those sections define an elevated apex. The adjustability of the upper body, thigh and calf sections allow a user to control the contour or profile of the frame. Portions of the mattress that overlie the upper body, seat, thigh and calf sections of the frame are designated as mattress upper body, seat, thigh and calf sections. The mattress is affixed to the frame so that its contour conforms to that of the frame.

The adjustability of the various frame sections and the conformability of the mattress can contribute to occupant comfort. For example it is not uncommon for the upper body section to be at an orientation of up to about 65° or 70° relative to horizontal and for the thigh and calf sections to be oriented so that the mattress fully supports the occupant's legs when the occupant is supine with his or her legs bent at the knees. The adjustability can also help mitigate the inherent tendency of the upper body section to push the occupant toward the foot of the bed when the upper body section undergoes a change in orientation from a more horizontal orientation to a less horizontal (i.e. more vertical) orientation. For example, as the upper body section is rotated upwardly (further away from horizontal), the thigh and calf sections can be concurrently rotated from horizontal to non-horizontal. The rotation of the thigh section places it at an inclination that causes the corresponding mattress section to resist the tendency of the upper body section to push the occupant footwardly.

Some bed frames may not feature the full spectrum of adjustability described above. For example, some frames may have an adjustable upper body section as described, but not adjustable thigh and calf sections. As a result, the bed is unable to counteract the tendency of the upper body section to push the occupant footwardly. Consequently, it may be necessary for a caregiver to reposition the occupant. The repositioning diverts the caregiver's time from other tasks and involves risk of injury to the caregiver. Moreover, involuntary occupant migration along the mattress can impart shear stress and stretch to the occupant's skin and soft tissue, resulting in risk of skin injury.

Accordingly, it is desirable to provide a mattress able to compensate for lack of adjustability of the frame, particularly a lack of orientation adjustability in the lower body section.

SUMMARY

A mattress for use on a bed frame having a lower body section and an orientation adjustable upper body section includes a mattress lower body section and a mattress upper body section. The mattress upper body section is orientation adjustable as a function of orientation adjustment of the frame upper body section. At least part of the mattress lower body section is profile adjustable as a function of the orientation of the mattress upper body section without being dependent on profile adjustment of the frame lower body section.

A mattress replacement system includes a mattress having an orientation adjustable upper body section and a lower body section and an orientation sensor for determining the orientation of the upper body section. At least part of the mattress lower body section is profile adjustable in response to the determined orientation of the mattress upper body section.

BRIEF DESCRIPTION OF THE DRAWINGS

The foregoing and other features of the various embodiments of the mattress and mattress replacement system described herein will become more apparent from the following detailed description and the accompanying drawings in which:

FIG. 1A is a schematic view showing communication between an angular orientation sensor and the controller of FIG. 1 and between the controller and hardware controlled by the controller.

FIG. 2A is a graph of the elasticity of the bladder of FIG. 2 as a function of longitudinal position.

DETAILED DESCRIPTION

Figure 1:
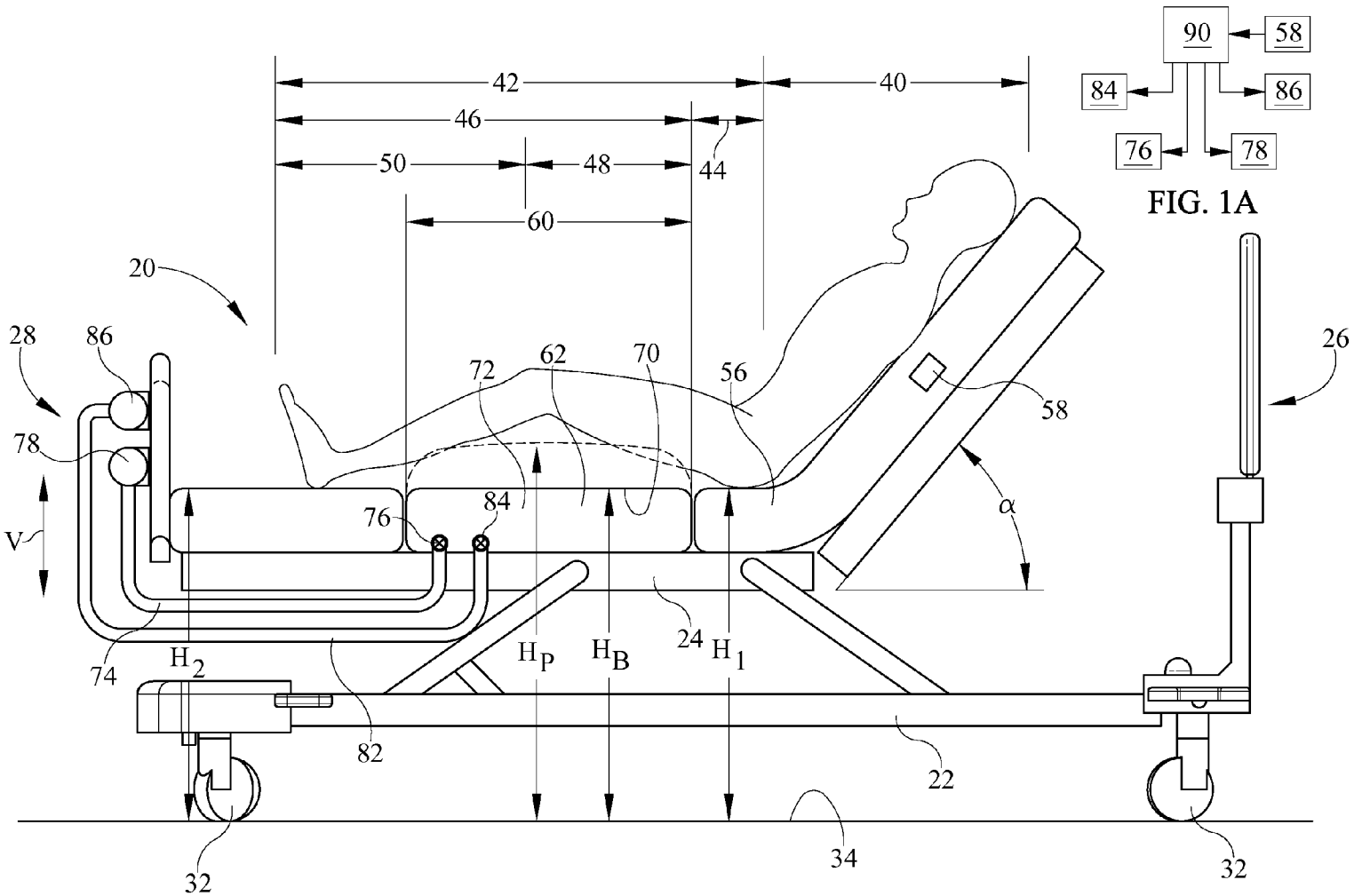
FIG. 1 is a schematic, side elevation view of a hospital bed showing a mattress as described herein having a profile adjustable zone including a pressurizable bladder having a baseline state (solid lines) and a profiled state (dashed lines) and also having an angular orientation sensor to determine the angular orientation $\alpha$ of an upper body section of the mattress.

Referring to FIG. 1 a hospital bed 20 includes a base frame 22 and an elevatable frame 24 which is vertically moveable relative to the base frame as indicated by directional arrow V. The bed extends longitudinally from a head end 26 to a foot end 28 and laterally from a left side (seen in the plane of the illustration) to a right side. Casters 32 extend from the base frame to floor 34. The elevatable frame 24 includes an upper body or torso section 40 corresponding approximately to an occupant's torso. The upper body section 40 is orientation adjustable through an angle α from a substantially horizontal orientation (0°) to a more vertical orientation. The frame also includes a lower body section 42 corresponding approximately to the occupant's buttocks, thighs and calves. The lower body section may be thought of as comprising a seat section 44 and a leg section 46 corresponding approximately to an occupants buttocks and legs respectively; the leg section 46 may be thought of as comprising a thigh section 48 and a calf section 50 corresponding approximately to an occupant's thighs and calves respectively. However unlike the frame described in the background of this specification, the calf and thigh sections are not orientation adjustable.

Bed 20 also includes a mattress 56 having an upper body or torso section, a seat section, a thigh section and a calf section, each corresponding approximately to an occupant's torso, buttocks, thighs and calves. Because of the correspondence between the mattress and frame sections the mattress sections are identified by the same reference numerals 40, 42, 44, 46, 48, 50 used to identify the corresponding frame sections. The mattress is affixed to the elevatable frame in any suitable manner such that mattress upper body section 40 changes angular orientation in concert with any change in the angular orientation of the frame upper body section. Because the angular orientation of the mattress upper body section is substantially the same as that of frame upper body section, the symbol α is used to denote both orientations. An angular orientation sensor 58, such as an inclinometer, is attached to the mattress to determine angular orientation α. As described in more detail below, a mattress zone 60 comprising at least part of mattress lower body section 42 is profile adjustable as a function of the orientation α of the mattress upper body section without being dependent on any corresponding profile adjustability of the frame lower body section.

The profile adjustable zone 60 of mattress lower body section 42 comprises at least one pressurizable bladder 62 having a jacket 70 that bounds a bladder internal region 72. A fluid supply line 74 fitted with a supply valve 76 connects the bladder to a fluid source such a compressor 78. A fluid discharge line 82 fitted with a discharge valve 84 connects the bladder to an aspirator such as a pump 86. A controller 90 commands the compressor 78, aspirator 86 and valves 76, 84 to admit pressurized fluid, typically air, to the bladder and to vent fluid from the bladder. As a result, the bladder can be placed in a baseline state corresponding to a baseline mattress height $H_B$ of the profile adjustable part of the mattress. Baseline height $H_B$ is approximately the same as the heights $H_1$, $H_2$ of the longitudinally adjacent portions of the mattress. As a result the baseline state of the profile adjustable zone 60 corresponds to a substantially flat profile of the mattress lower body section. The bladder can also be placed in a profiled state corresponding to a profiled mattress height $H_P$ which differs from baseline height $H_B$ and which may also vary longitudinally. In the illustrated embodiment, the baseline state is achieved by inflating the bladder to a baseline inflation pressure; the profiled state is achieved by overinflating the bladder to a higher pressure.

Figure 2:
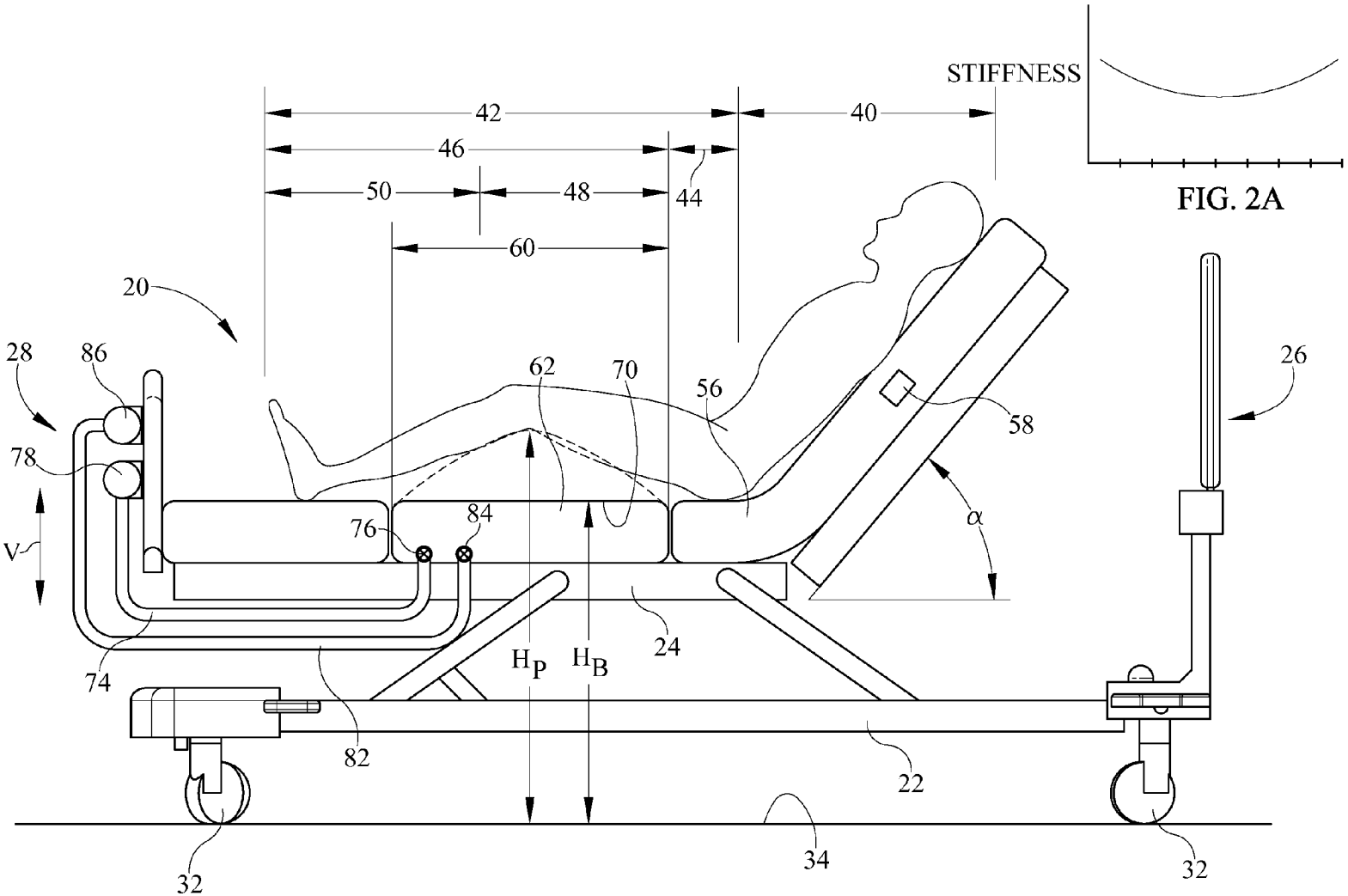
FIG. 2 is a view similar to that of FIG. 1 in which the jacket of the bladder has a spatially varying elasticity.
Figure 3:
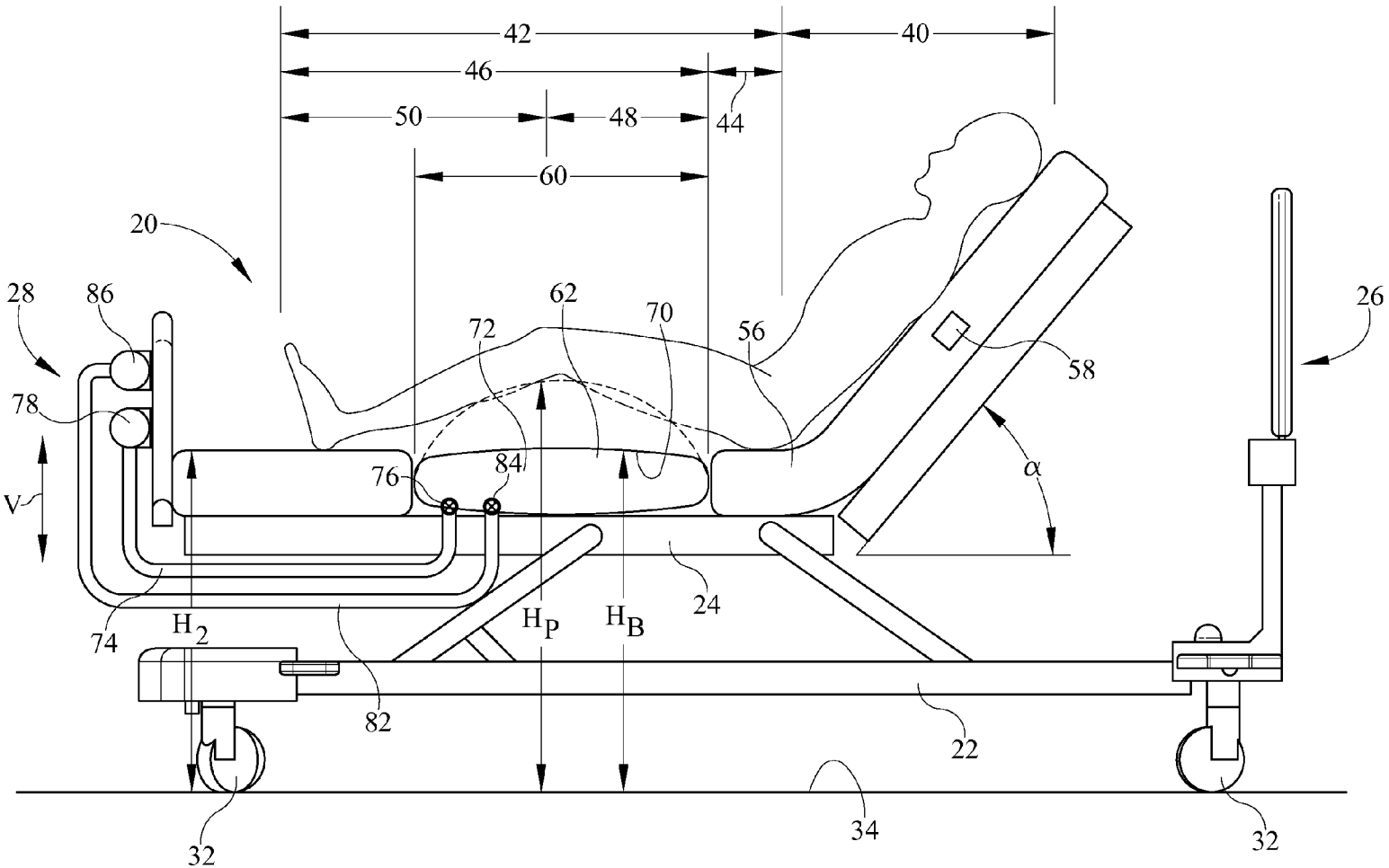
FIG. 3 is a view similar to that of FIG. 1 in which the bladder has a more oval cross sectional shape.

FIG. 2 shows a variant in which the uppermost portion of the bladder jacket 70 has a spatially varying elasticity. More specifically the jacket is relatively stiff at the longitudinal extremities of the bladder and relatively weaker near the longitudinal midpoint as indicated in FIG. 2A. The varying elasticity influences the profile of the bladder in its profiled state. For example the profiled state of the nonuniformly elastic bladder of FIG. 2 is approximately triangular in cross section, whereas the profiled state of the uniformly elastic bladder of FIG. 1 is approximately rectangular in cross section. As seen in FIG. 3 the cross sectional geometry and construction of the bladder can also be used to influence the shape of the bladder in its profiled state. For example, whereas the bladder of FIG. 1 has a substantially rectangular cross sectional shape in both its baseline and profiled states, the bladder of FIG. 3 has a more oval shaped cross section in both states.

Figure 4A:
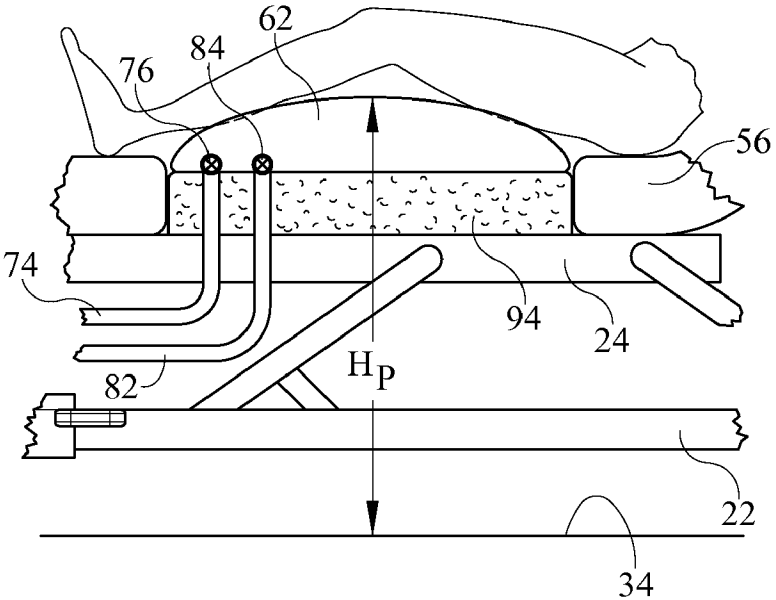
FIG. 4 is a view similar to that of FIG. 1 in which the bladder rests atop a foundation.
Figure 4:
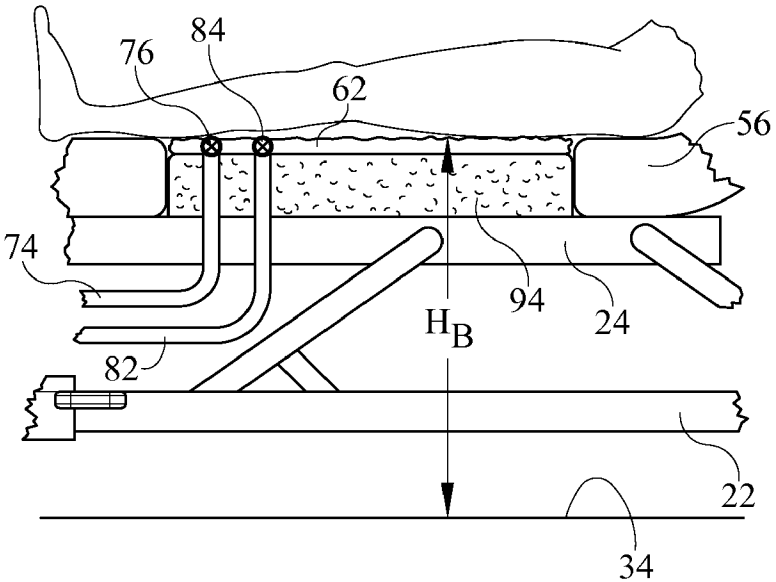

Referring to FIGS. 4 and 4A another variant of the mattress includes a foam foundation 94 beneath the bladder 62. The foundation may be made of other suitable materials, including rigid materials. Moreover, the foundation may be a component or feature of frame 24 rather than a component or feature of the mattress. In the embodiment of FIGS. 4 and 4A, the baseline state of the mattress (FIG. 4) is achieved by substantially deflating the bladder; the profiled state of the mattress (FIG. 4A) is achieved by inflating the bladder to a suitable inflation pressure.

Figure 5A:
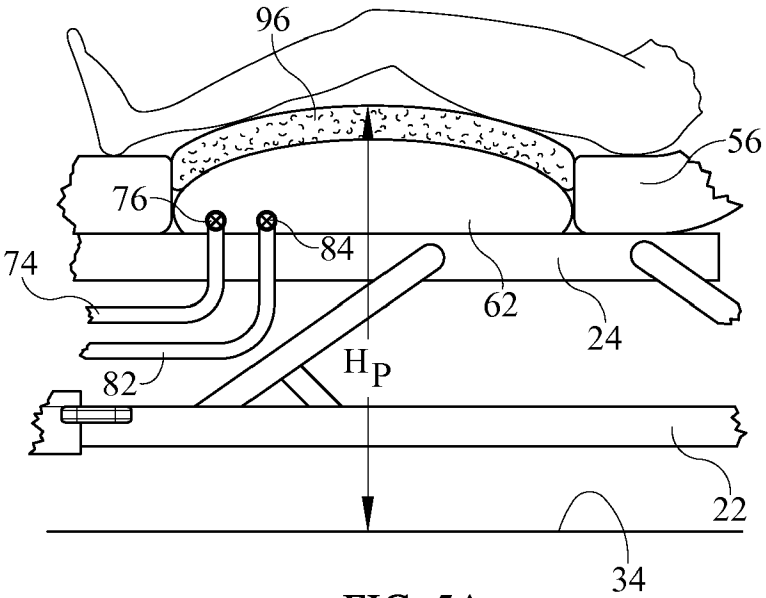
FIGS. 5 and 5A are views similar to that of FIG. 1 in which an overlay is positioned above the bladder.
Figure 5:
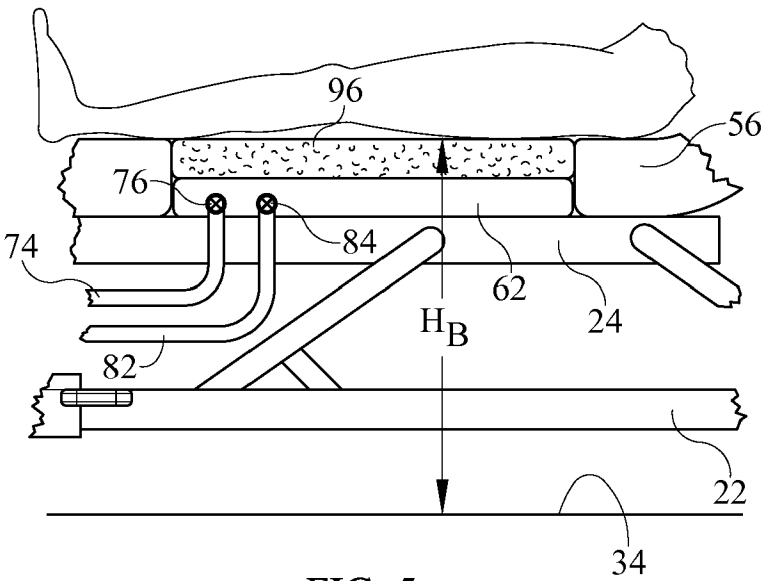

FIGS. 5 and 5A show an alternative construction in which the mattress includes a foam overlay 96 positioned above the bladder and secured to the longitudinally adjacent portions of the mattress. In the baseline state of FIG. 5 the bladder is inflated to a baseline pressure resulting in a substantially flat mattress profile along the lower body section. In the profiled state of FIG. 5A the bladder is overinflated, causing the overlay to deflect and define the profiled state of the mattress.

Figure 6A:
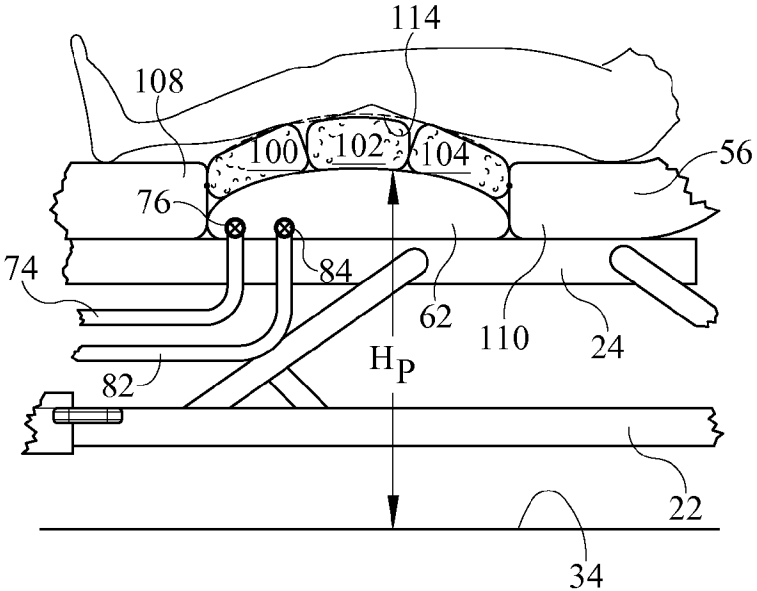
FIGS. 6 and 6A are views similar to those of FIGS. 5 and 5A in which the overlay comprises two or more overlay segments.
Figure 6:
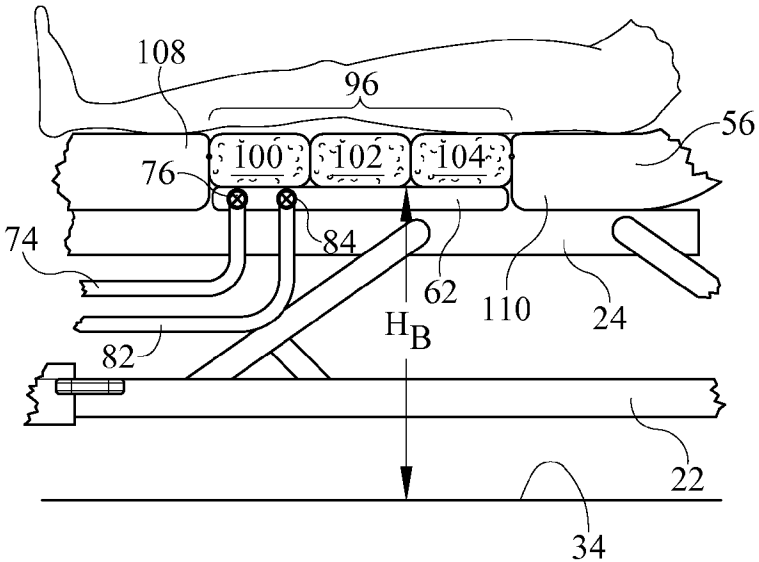
Figure 7:
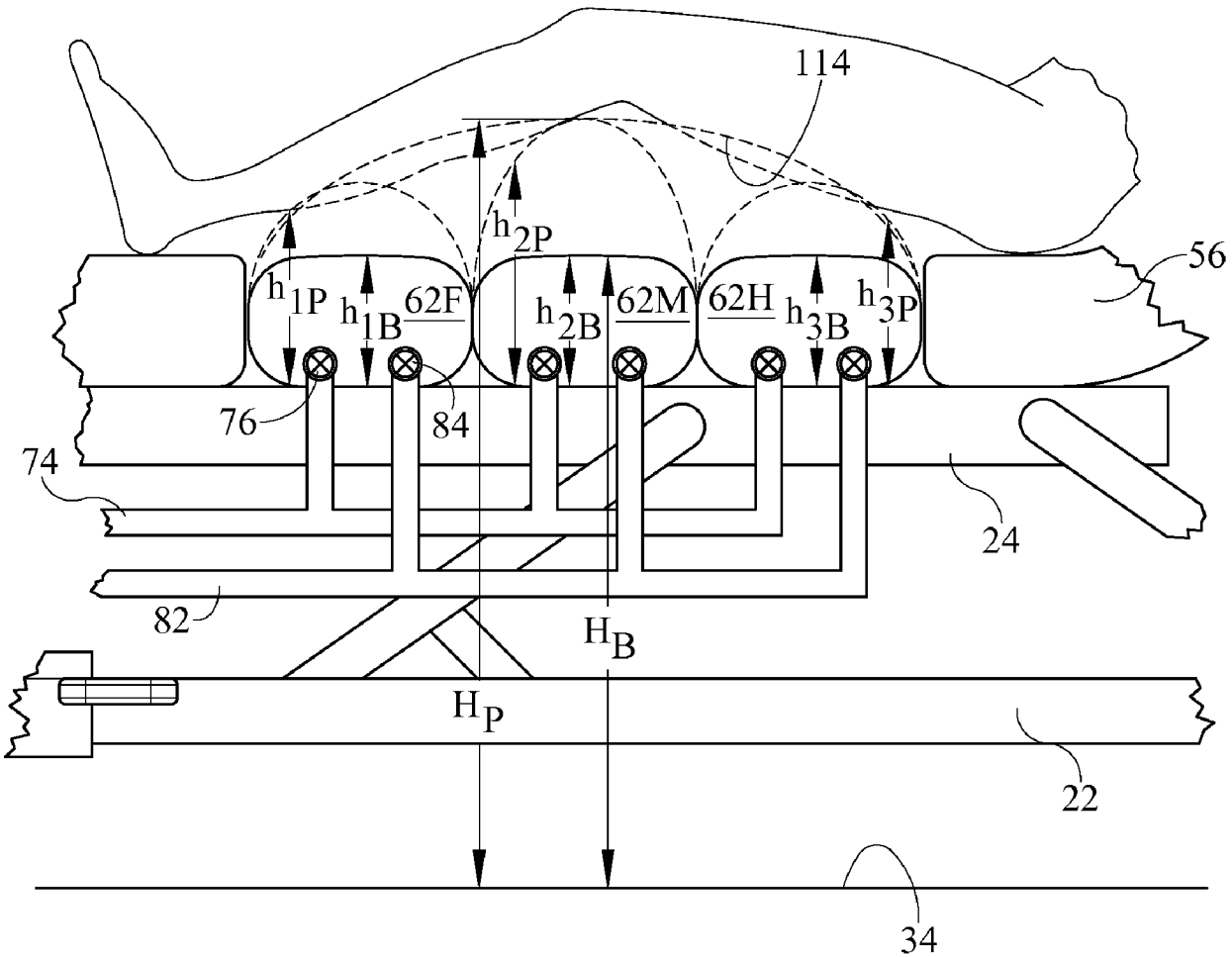
FIG. 7 is a view similar to that of FIG. 1 in which the adjustable zone comprises multiple pressurizable bladders.

FIGS. 6 and 6A show another variant in which overlay 96 comprises two or more overlay segments such as a foot end segment 100 secured to an adjacent part 108 of the mattress, a head end segment 104 secured to an adjacent part 110 of the mattress, and a medial segment 102 secured to the head and foot end segments. In the baseline state of FIG. 6 the bladder 62 is inflated to a baseline pressure so that the overlay segments are horizontally aligned, resulting in a substantially flat mattress profile along the lower body section. In the profiled state of FIG. 6A the bladder is overinflated, causing the overlay segments to describe a curved mattress profile 114.

FIGS. 7-11 show the use of two or more bladders in the profile adjustable zone 60. The embodiment of FIG. 7 employs head, medial and foot end bladders 62H, 62M, 62F but is otherwise similar to the embodiment of FIG. 1 in that neither a foundation 94 (FIGS. 4, 4A) nor an overlay 96 (FIGS. 5, 5A) is used. In the baseline state the bladders are inflated to approximately equal baseline bladder heights $h_{1B}$, $h_{2B}$, $h_{3B}$ resulting in a substantially flat mattress profile along the lower body section. In the profiled state the bladders are inflated to different heights $h_{1P}$, $h_{2P}$, $h_{3P}$ thereby defining a curved, mattress profile 114 having a longitudinally varying height H.

Figure 8:
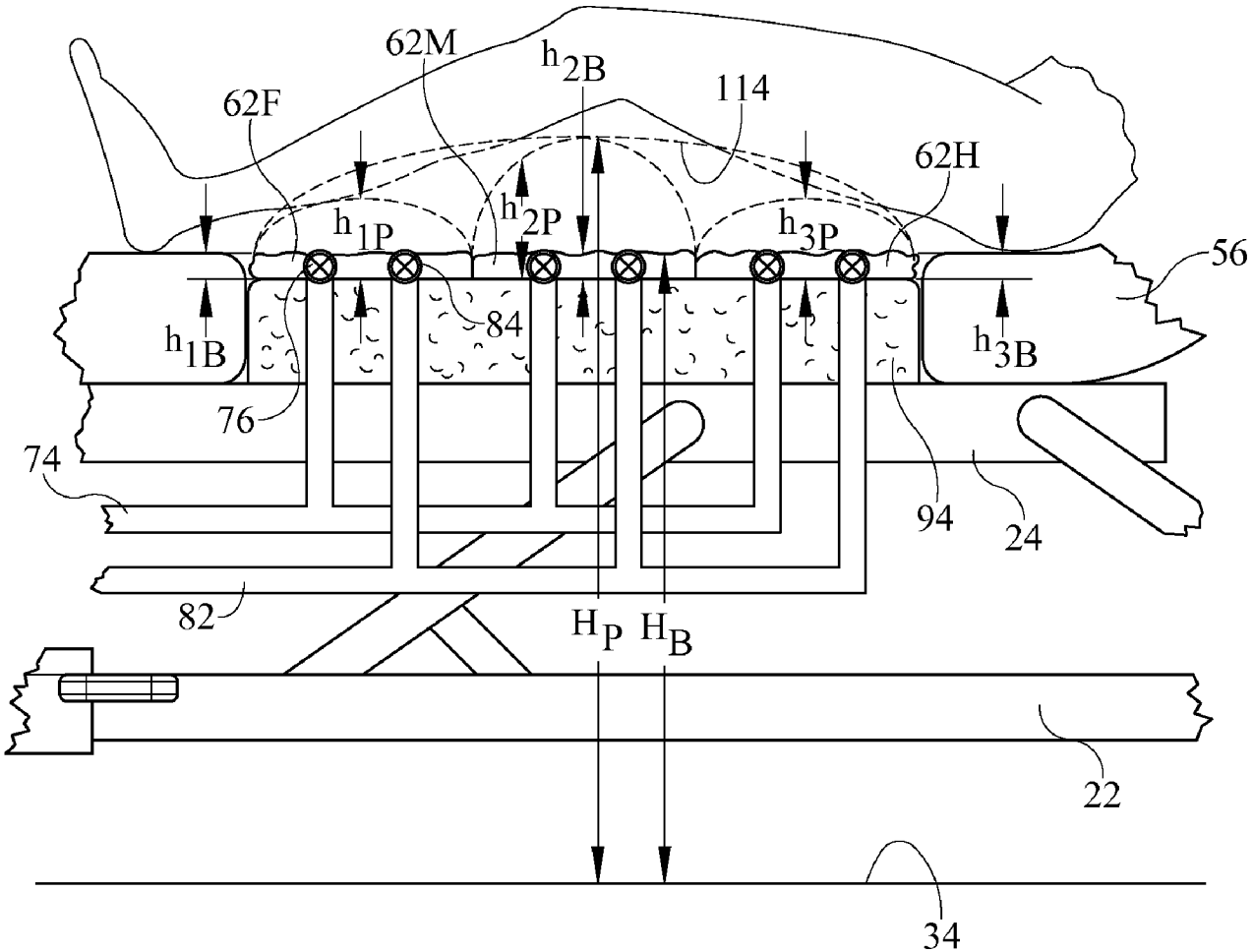
FIG. 8 is a view similar to that of FIG. 7 in which the bladders rests atop a foundation.

The embodiment of FIG. 8 is similar to that of FIGS. 4, 4A in that a foundation 94 resides beneath the multiple bladders 62. In the baseline state the bladders are inflated to approximately equal baseline bladder heights $h_{1B}$, $h_{2B}$, $h_{3B}$ resulting in a substantially flat mattress profile of height $H_B$ along the lower body section. In the profiled state the bladders are inflated to different heights $h_{1P}$, $h_{2P}$, $h_{3P}$ so that the mattress has a curved profile 114 of longitudinally varying height H.

Figure 9A:
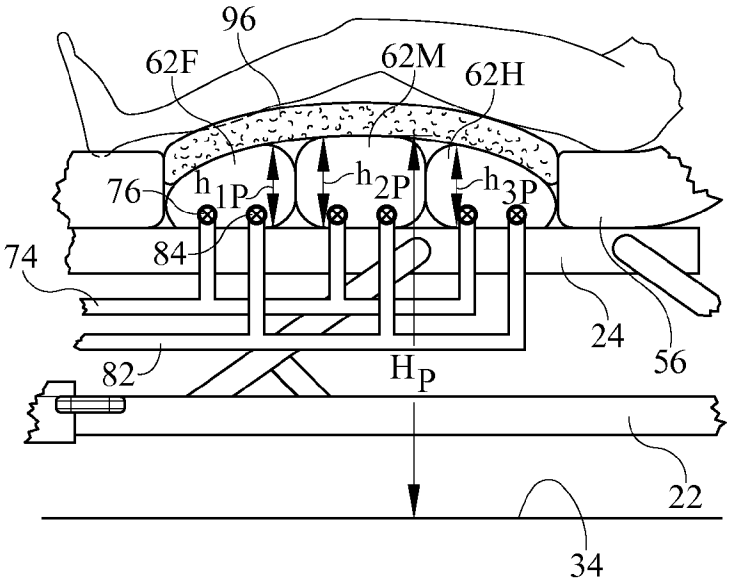
FIGS. 9 and 9A are views similar to those of FIGS. 5 and 5A in which an overlay is positioned above the bladders.
Figure 9:
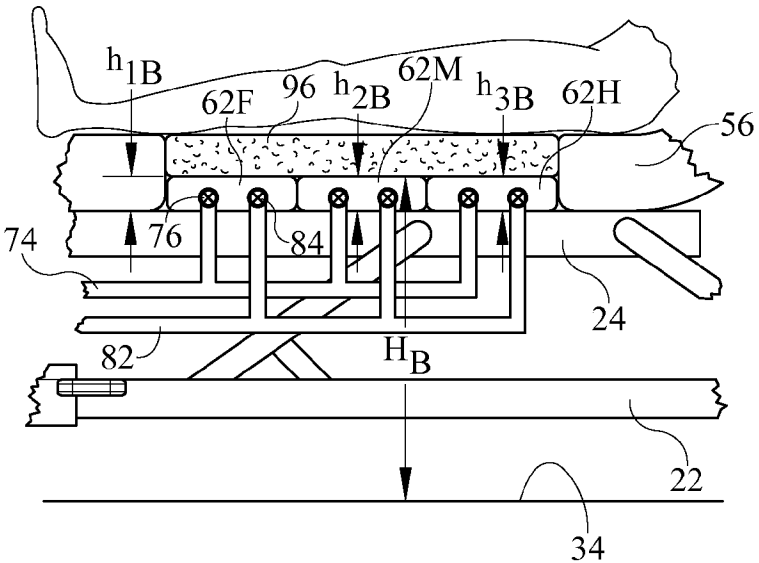

The embodiment of FIG. 9 is similar to that of FIGS. 5 and 5A in that an overlay 96 is positioned above the bladders 62 and secured to the longitudinally adjacent portions of the mattress. In the baseline state the bladders are inflated to approximately equal baseline bladder heights $h_{1B}$, $h_{2B}$, $h_{3B}$ resulting in a substantially flat mattress profile of height $H_B$ along the lower body section. In the profiled state the bladders are inflated to unequal heights $h_{1P}$, $h_{2P}$, $h_{3P}$, thereby deflecting the overlay to achieve a curved profile having a longitudinally varying height $H_P$.

Figure 10:
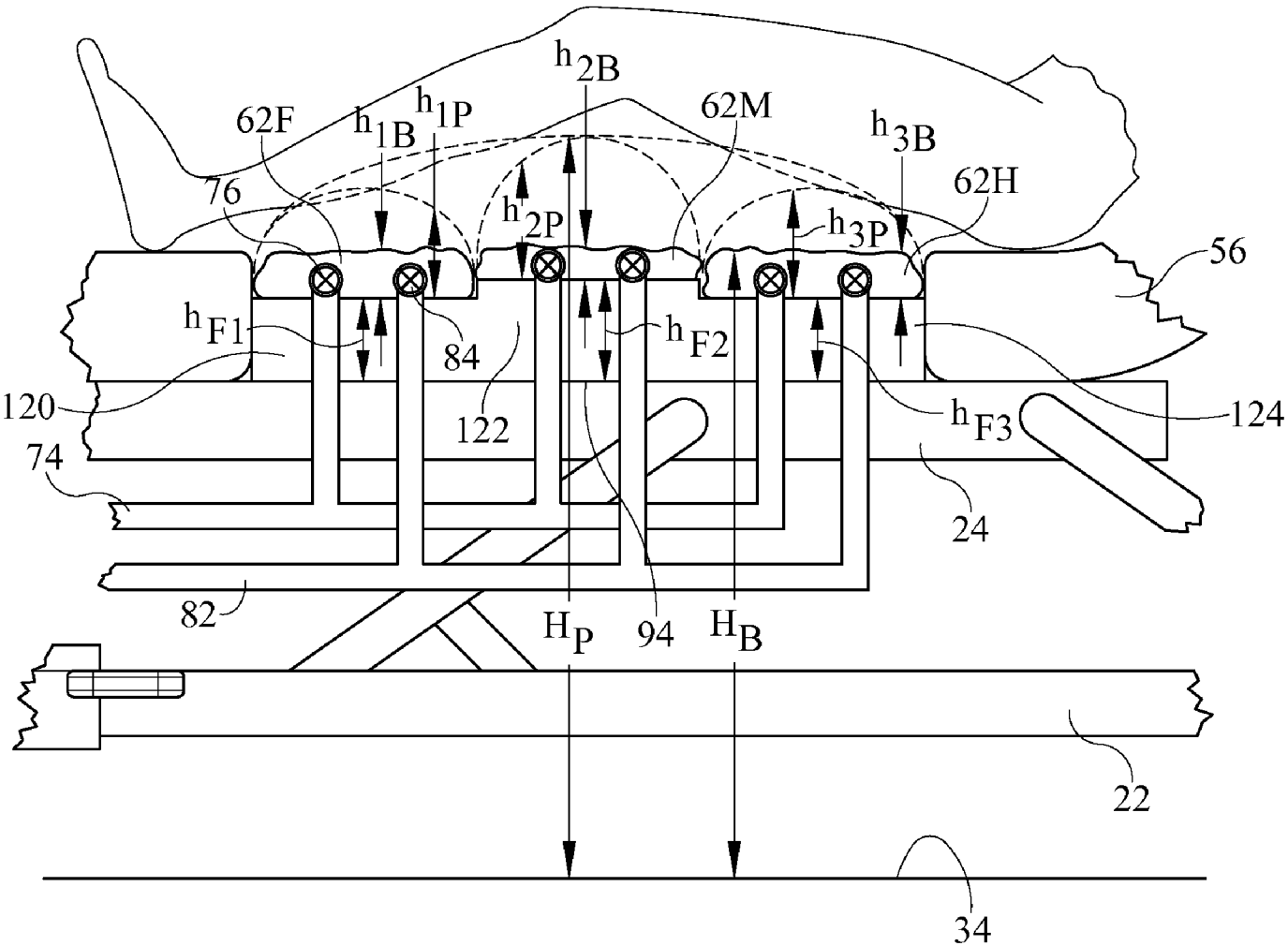
FIG. 10 is a view similar to that of FIG. 8 showing a varying height foundation.

In the embodiment of FIG. 10 the mattress includes a foundation whose height varies longitudinally. Foot end foundation section 120 has a height $h_{F1}$; medial foundation section 122 has a height $h_{F2}$; head end foundation section 124 has a height $h_{F3}$. Foot, medial, and head end bladders 62F, 62M, 62H rest atop each foundation section. In the baseline state the bladders are inflated to baseline heights $h_{B1}$, $h_{B2}$, $h_{B3}$ resulting in a substantially flat mattress profile of height $H_B$ along the lower body section. In the profiled state the bladders are inflated to their profiled heights $h_{1P}$, $h_{2P}$, $h_{3P}$ such that the mattress height $H_P$ with the bladders in their profiled states varies longitudinally to achieve a prescribed, longitudinally varying mattress height along the lower body section.

Figure 11A:
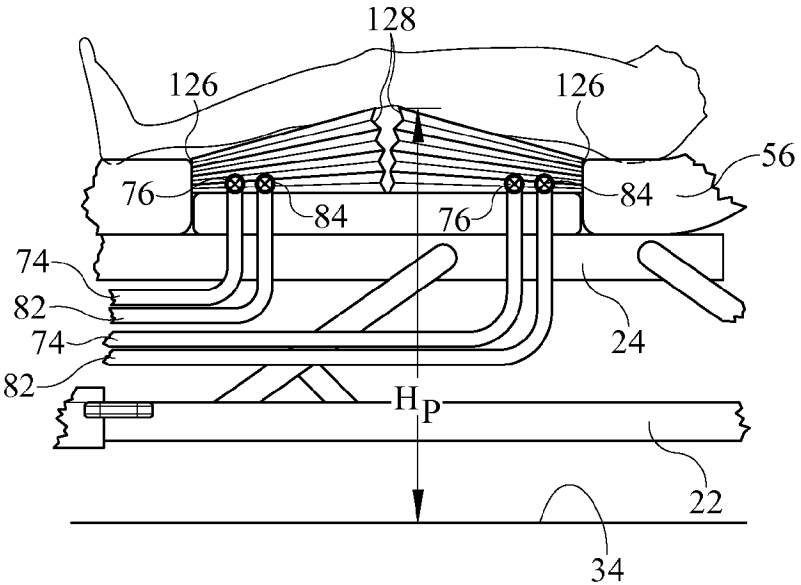
FIG. 11 is a view similar to that of FIG. 7 in which the multiple bladders are bellows bladders.
Figure 11:
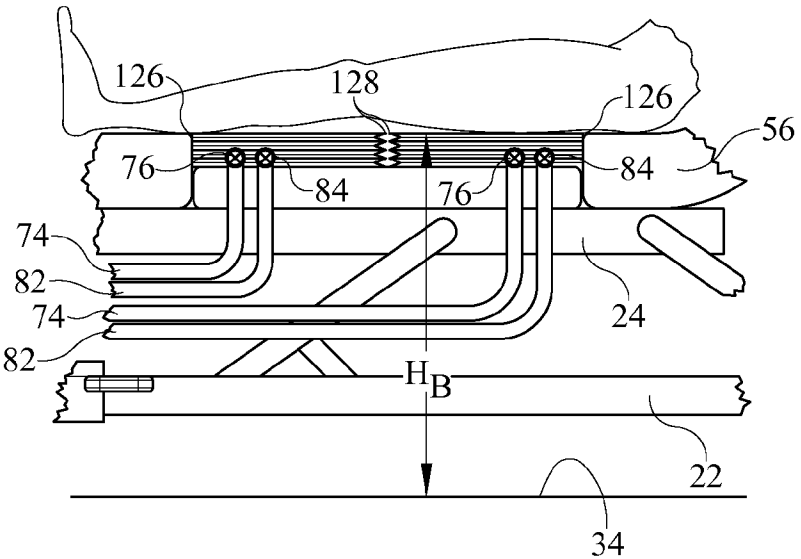

In the embodiments of FIGS. 11 and 11A the bladders 62 are bellows bladders each having a fixed end 126 and an expandable end 128. In the baseline state of FIG. 11 the bladders are substantially deflated, resulting in a substantially flat mattress profile of height $H_B$ along the lower body section. In the profiled state of FIG. 11A the bladders are inflated so that they expand as shown to define a mattress profile having a longitudinally varying height $H_P$.

Figure 12:
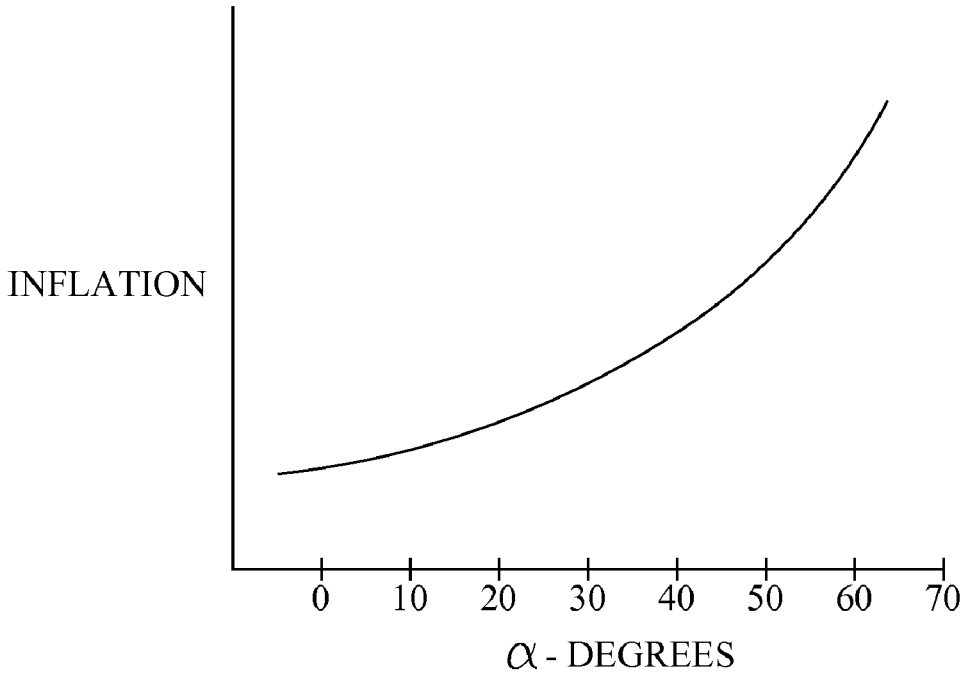
FIG. 12 is a graph showing an example variation of bladder inflation as a function of the angular orientation α of the upper body section of the mattress.

In operation, the angular orientation sensor 58 senses the angular orientation of mattress or frame upper body section 40. Controller 90 receives the angular orientation readings and, in response thereto, commands appropriate operation of the valves, 76, 84, compressor 78 and aspirator 86 (FIG. 1A) to adjust the internal pressure in the bladder or bladders of the profile adjustable zone, thereby adjusting the mattress profile despite the absence of any adjustability of the part of the bed frame on which the adjustable zone rests. By transitioning the mattress from its baseline state to a profiled state as a function of increasing values of orientation angle $\alpha$, the portion of the profile adjustable zone 60 facing the occupant's thighs and buttocks can help resist the tendency of the upper body section to push the occupant toward the foot end 28 of the bed. FIG. 12 shows a graph of bladder inflation representing, for example, bladder pressure and/or bladder height $h_P$ as a function of $\alpha$. Such a relationship, as well as those described below, could be built into the controller as equations or look-up tables.

Figure 13:
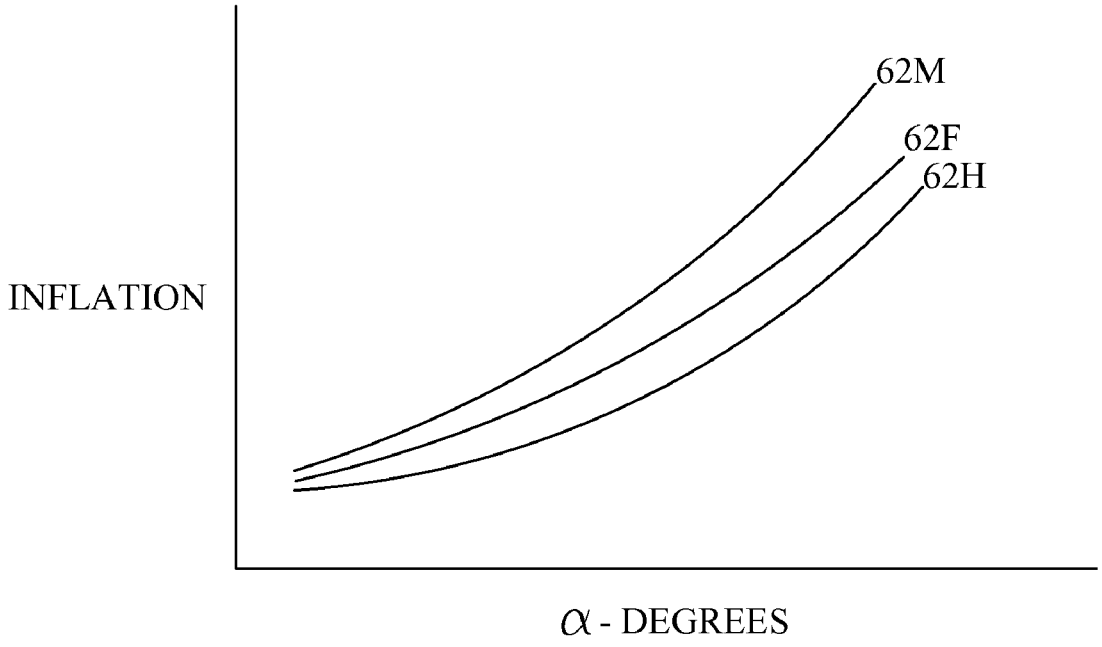
FIG. 13 is a graph showing an example variation of bladder inflation as a function of the angular orientation α of the upper body section of the mattress and of longitudinal position within the profile adjustable zone.

If the mattress employs multiple bladders in the profile adjustable zone (FIGS. 7-11) the bladders may be inflated differently (e.g. to different pressures and/or to different heights). Using the bladder architecture of FIG. 7 as an example, FIG. 13 shows a graph of bladder inflation as a function of both $\alpha$ and of bladder longitudinal position within the profile adjustable zone. In the example the medial bladder 62M is subjected to greater inflation than either the head end or foot end bladders 62H, 62F.

Figure 14:
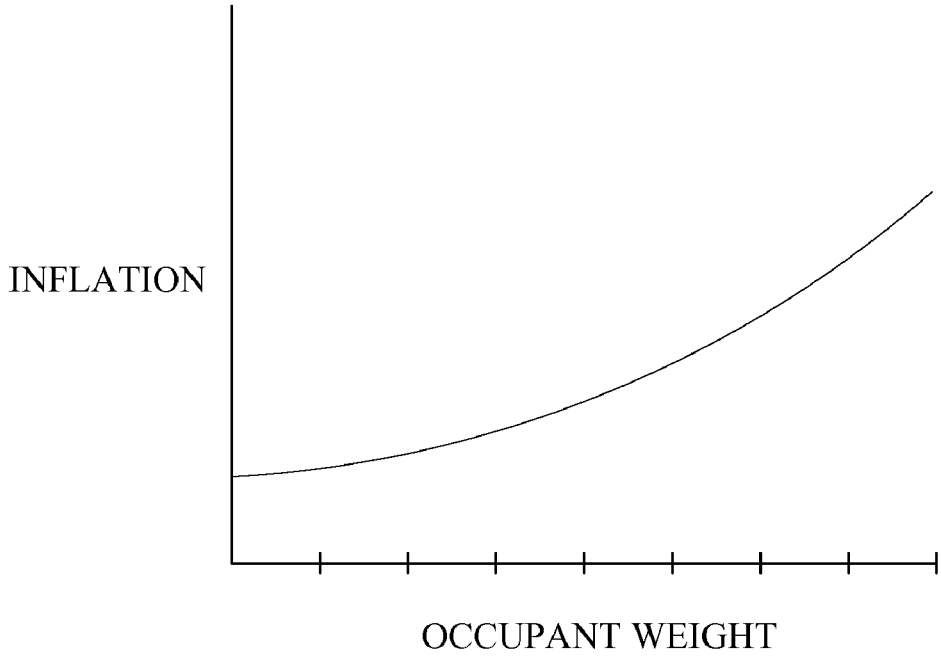
FIG. 14 is a graph showing an example variation of bladder inflation as a function of occupant weight.
Figure 15:
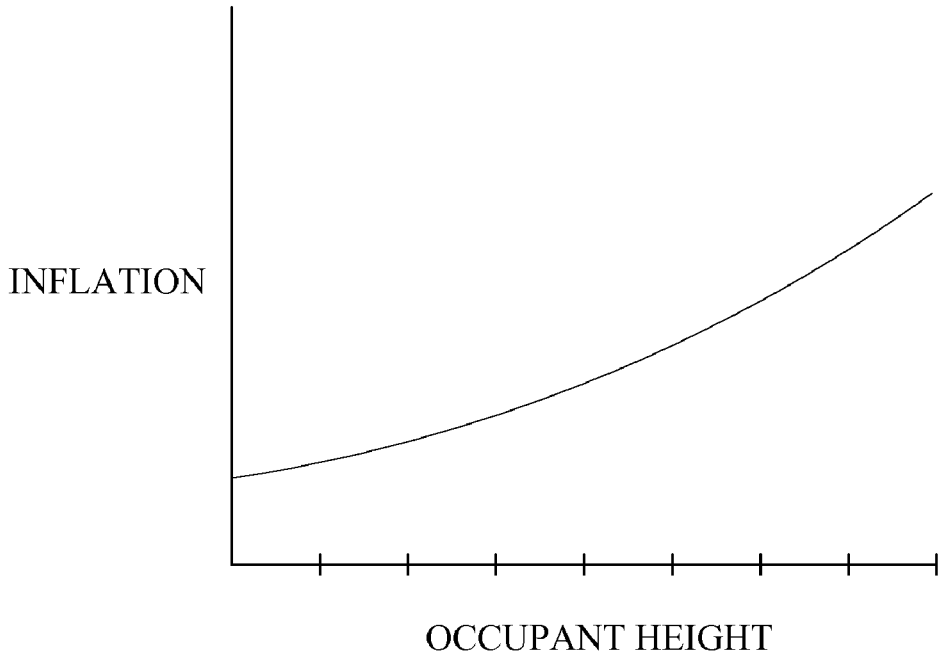
FIG. 15 is a graph showing an example variation of bladder inflation as a function of occupant height.

Occupant anthropometric characteristics and morphology may also be taken into account in determining appropriate bladder inflation. FIG. 14 shows a sample graphical relationship of inflation of a given bladder as a function of occupant weight. FIG. 15 similarly shows inflation of a given bladder as a function of occupant height. These relationships can be used as refinements to the relationships of FIGS. 12 and/or 13 or can be used independently.

In commercial practice the mattress can be offered as a component of a bed whose other components include a frame. The mattress can also be offered to customers as a mattress replacement system, in which case the mattress would be installed on the customer's existing bed frame. The mattress replacement system could include only the mattress 20 or it could include other components such as the compressor 78, aspirator 86, plumbing components (e.g. supply and discharge lines 74, 82 and valves 76, 84) control logic boards, software, and an angular orientation sensor 58. The angular orientation sensor may be pre-affixed to the mattress or it may be a separate component attachable to the mattress or frame upper body section 40.

In view of the foregoing, certain additional aspects of the described mattress and mattress replacement system can now be better appreciated.

Several of the examples portray the baseline state of the mattress as one corresponding to a baseline inflation of the bladder or bladders, and portray the profiled state as one corresponding to overinflation of the bladder or bladders. However the baseline state can be one corresponding to underinflation or deflation of the bladder or bladders, and the profiled mattress state can correspond to higher inflation of the bladder or bladders.

Different bladder heights may be achieved in a number of satisfactory ways, for example by using different bladder sizes, different inflation pressures, bladders of different (or varying) elastic properties, or combinations thereof. Varying mattress height may be also be achieved in any suitable way, for example by using different bladder heights, or by using bladders of equal heights supported on foundations of differing heights or combinations thereof.

The foregoing disclosure emphasizes the benefits of counteracting involuntary migration of the bed occupant in response to an orientation change of the upper body section, however the provision of a mattress-based contour capability may also be advantageous for enhancing occupant comfort.

The mattress and mattress replacement system have been described in the context of a bed frame whose thigh and calf sections lack orientation adjustability. However the mattress and mattress replacement system described herein can also be used on a frame possessing such adjustability, in which case the use of the frame adjustability would not be required.

Although this disclosure refers to specific embodiments, it will be understood by those skilled in the art that various changes in form and detail may be made without departing from the subject matter set forth in the accompanying claims.

We claim:

1. A mattress for use on a bed frame having a lower body section and an orientation adjustable upper body section, the mattress having a lower body section and an upper body section, the mattress upper body section being orientation adjustable, at least part of the mattress lower body section being capable of introducing a profile change of the mattress lower body section as a function of the orientation of the mattress upper body section without being dependent on profile adjustment of the frame lower body section.

2. The mattress of claim 1 wherein the profile adjustable part of the mattress lower body section comprises at least one bladder having a baseline state corresponding to a baseline height of the profile adjustable part of the mattress and also having a profiled state corresponding to a profiled height different from the baseline height.

3. The mattress of claim 2 wherein the profiled mattress height varies spatially.

4. The mattress of claim 2 wherein the profile adjustable part of the mattress comprises at least two longitudinally distributed bladders each having a baseline state and a profiled state.

5. The mattress of claim 4 wherein the profiled state of the at least two bladders defines a mattress profile having a longitudinally varying height.

6. The mattress of claim 4 comprising bladders whose profiled states correspond to different bladder heights.

7. The mattress of claim 4 comprising bladders having substantially equal bladder heights in their profile states, the bladders being longitudinally distributed on a foundation whose height varies longitudinally such that the mattress height with the bladders in their profiled states reflects a prescribed longitudinal variation in the mattress height.

8. The mattress of claim 7 wherein the foundation is a component of the mattress.

9. The mattress of claim 7 wherein the foundation is not a component of the mattress.

10. The mattress of claim 4 wherein bladder height is a function of an angle of orientation of one of the upper body section of the mattress and the upper body section of the frame.

11. The mattress of claim 4 wherein bladder height is a function of bladder inflation.

12. The mattress of claim 11 wherein bladder inflation is a function of occupant weight.

13. The mattress of claim 11 wherein bladder inflation is a function of occupant height.

14. The mattress of claim 2 including a foundation beneath the at least one bladder.

15. The mattress of claim 2 including an overlay above the at least one bladder.

16. The mattress of claim 2 wherein at least one of the at least one bladders is a bellows bladder.

17. The mattress of claim 1 comprising an angular orientation sensor for indicating the angular orientation of the mattress.

18. The mattress of claim 1 in which the lower body section comprises a seat section, a thigh section and a calf section and the thigh and calf sections are profile adjustable as a function of the orientation of the mattress upper body section without being dependent on profile adjustment of the frame lower body section.

19. The mattress of claim 18 wherein the profile adjustment is manifested as an increase in elevation of the thigh and calf sections relative to the elevation of the seat section.

20. The mattress of claim 1 in which at least part of the mattress lower body section and only the lower body section is profile adjustable as a function of the orientation of the mattress upper body section without being dependent on profile adjustment of the frame lower body section.

21. The mattress of claim 1 in which at least part of the mattress lower body section is profile adjustable as a function of only the orientation of the mattress upper body section without being dependent on profile adjustment of the frame lower body section.

22. A mattress replacement system, comprising:

a mattress having an orientation adjustable upper body section and a lower body section;

an orientation sensor for determining the orientation of the mattress upper body section;

at least part of the mattress lower body section being capable of introducing a profile change of the mattress lower body section in response to the determined orientation of the mattress upper body section.

23. The mattress replacement system of claim 22 wherein the profile adjustable part comprises at least one bladder.

24. The mattress replacement system of claim 23 comprising a source of pressurized fluid for inflating the at least one bladder.

25. The mattress replacement system of claim 22 wherein the orientation sensor is installed on or is installable on the mattress.

26. The mattress replacement system of claim 22 wherein the orientation sensor is installable on a host bed frame.

* * * * *